US006076616A

United States Patent [19]

Kramp et al.

[11] Patent Number: 6,076,616

[45] Date of Patent: Jun. 20, 2000

[54] WORKING TOOL WHICH CAN BE GUIDED IN A GRAB HANDLE

[75] Inventors: Edith Kramp; Rudolf Berger; Thomas Maurer, all of München, Germany

[73] Assignee: Wacker-Werke GmbH & Co. KG, Germany

[21] Appl. No.: 09/171,016

[22] PCT Filed: Nov. 10, 1997

[86] PCT No.: PCT/EP97/06242

§ 371 Date: Oct. 8, 1998

§ 102(e) Date: Oct. 8, 1998

[87] PCT Pub. No.: WO98/21014

PCT Pub. Date: May 22, 1998

[30] Foreign Application Priority Data

Nov. 12, 1996 [DE] Germany ..... 196 46 622

[51] Int. Cl.[7] ..... E21B 3/00

[52] U.S. Cl. ..... 173/162.2; 173/211

[58] Field of Search ..... 173/162.2, 162.1, 173/210, 211; 267/137

[56] References Cited

U.S. PATENT DOCUMENTS

| | | | |
|---|---|---|---|
| 2,425,245 | 8/1947 | Johnson | 173/162.1 |
| 4,237,987 | 12/1980 | Sherman | 173/211 |
| 4,282,938 | 8/1981 | Minamidate | 173/162.2 |
| 4,421,181 | 12/1983 | Andersson et al. | 173/162.2 |
| 4,478,293 | 10/1984 | Weilenmann et al. | 173/162.2 |
| 4,711,308 | 12/1987 | Blaas et al. | 173/162.2 |
| 4,749,049 | 6/1988 | Greppmair | 173/162.2 |
| 4,800,965 | 1/1989 | Keller | 173/162.2 |
| 5,025,870 | 6/1991 | Gantner | 173/162.2 |
| 5,052,499 | 10/1991 | Dobry et al. | 173/162.1 |

FOREIGN PATENT DOCUMENTS

| | | |
|---|---|---|
| 0 206 981 | 12/1986 | European Pat. Off. . |
| WO 93/25352 | 12/1993 | European Pat. Off. . |
| 1-274973 | 11/1989 | Japan . |
| 2 297 514 | 8/1996 | United Kingdom . |
| WO 81/03518 | 12/1981 | WIPO . |

*Primary Examiner*—Peter Vo
*Assistant Examiner*—Jim Calve
*Attorney, Agent, or Firm*—Boyle Fredrickson Ziolkowski S.C.

[57] ABSTRACT

A tool having an operating element that is driven by an integrated power drive for the percussive, pounding or vibratory loading of a material to be worked, in particular a tamper, a vibration plate or a vibration roll for ground compaction or a hammer for breaking and/or drilling operations, can be guided using a handle. This handle is actively vibration-damped by at least one actively controlled or regulated compensation element, which counteracts the transmission of a vibration to the handle and which, depending on the vibration that can be transmitted to it and is produced in and/or on the tool, produces a compensating force and/or movement in the potential vibration transmission path from the location of production of the vibration to the handle.

19 Claims, 3 Drawing Sheets

WORKING TOOL WHICH CAN BE GUIDED IN A GRAB HANDLE

BACKGROUND OF THE INVENTION

1. Field of the Invention

The invention relates to a tool which can be guided using a handle, having an operating element that is driven by an integrated power drive for the percussive, pounding or vibratory loading of a material to be worked, in particular a tamper, vibration plate or vibration roll for ground compaction or a hammer for breaking and/or drilling operations.

2. Discussion of the Related Art

In the case of devices of this type, the transmission of the shocks or vibrations to the handle is not only unpleasant but also damaging to health, for which reason the operating time is limited in accordance with the intensity of this action. Trouble is therefore taken to keep the oscillations of the handle as small as possible.

For this purpose, at present only a passive reduction in oscillations by spring-damper elements and inertial masses is known, which is accompanied by the disadvantage that a large reduction in oscillations is possible only via large spring travels, which, for its part, in turn impairs the ability of the tool to be guided, and that a high efficiency of the reduction in oscillations is achieved only at high frequency ratios $\omega_{exciting}/\omega_{inherent}$.

EP-A-206 981 discloses a hand-held tool having an oscillation generator to which there is fastened a handle that can be displaced to a limited extent between two stops, parallel to the main oscillation axis. The stop for the handle which is arranged in the advance direction of the hand-held tool is designed as an electromagnet, the electromagnet being operated with an essentially constant direct current and producing a force which counteracts the contact pressure applied by the operator. The force of the electromagnet is controllable, in order to enable adaptation to the conditions which depend on the orientation of the hand-held tool.

OBJECTS AND SUMMARY OF THE INVENTION

The invention is based on the object of overcoming these disadvantages of the previously common reduction in oscillations at the handle that is to say to achieve a reduction in oscillations without large spring travels and with a high efficiency, even at low frequency ratios.

In the case of a tool of the type cited at the beginning, this object is achieved in that the handle is actively vibration-damped by at least one actively controlled or regulated compensation element, which counteracts the transmission of a vibration to the handle and which, depending on the vibration that can be transmitted to it and is produced in and/or on the tool, produces a compensating force and/or movement in the potential vibration transmission path from the location of production of the vibration to the handle.

As a result, over the entire frequency band, a high efficiency of the reduction in oscillations is achieved, irrespective of the contact pressure. The ability of the tool to be guided is not impaired by soft spring/damper elements. No large inertial masses are necessary, which would otherwise have an effect on the total weight of the device and in addition and possibly exhibit undesirable resonance phenomena.

BRIEF DESCRIPTION OF THE DRAWINGS

The invention will be explained in more detail below using exemplary embodiments illustrated in the drawings, in which.

DETAILED DESCRIPTION OF THE PREFERRED EMBODIMENT

Figure 1:
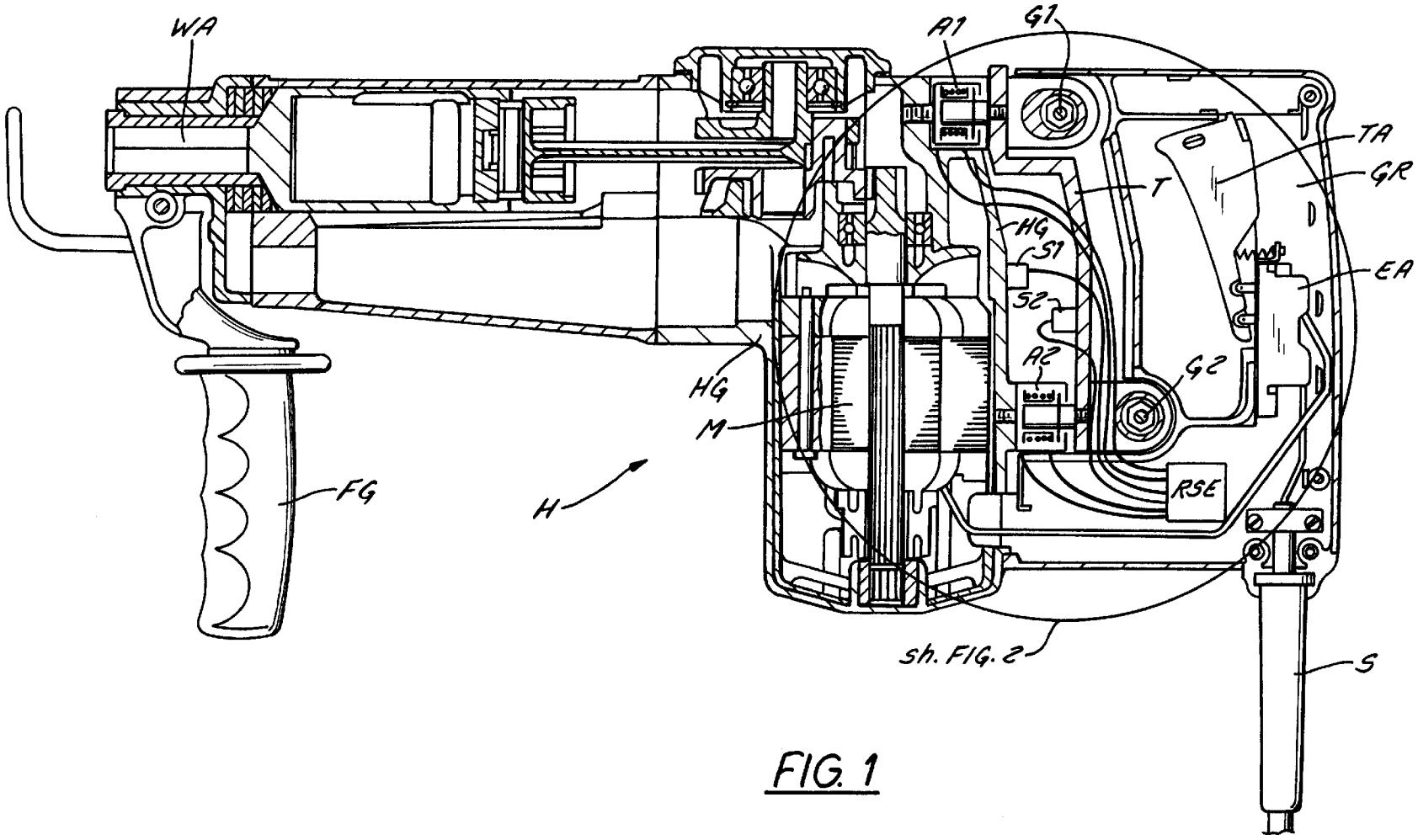
FIG. 1 shows a section through a breaker or hammer drill designed in accordance with the invention.
Figure 2:
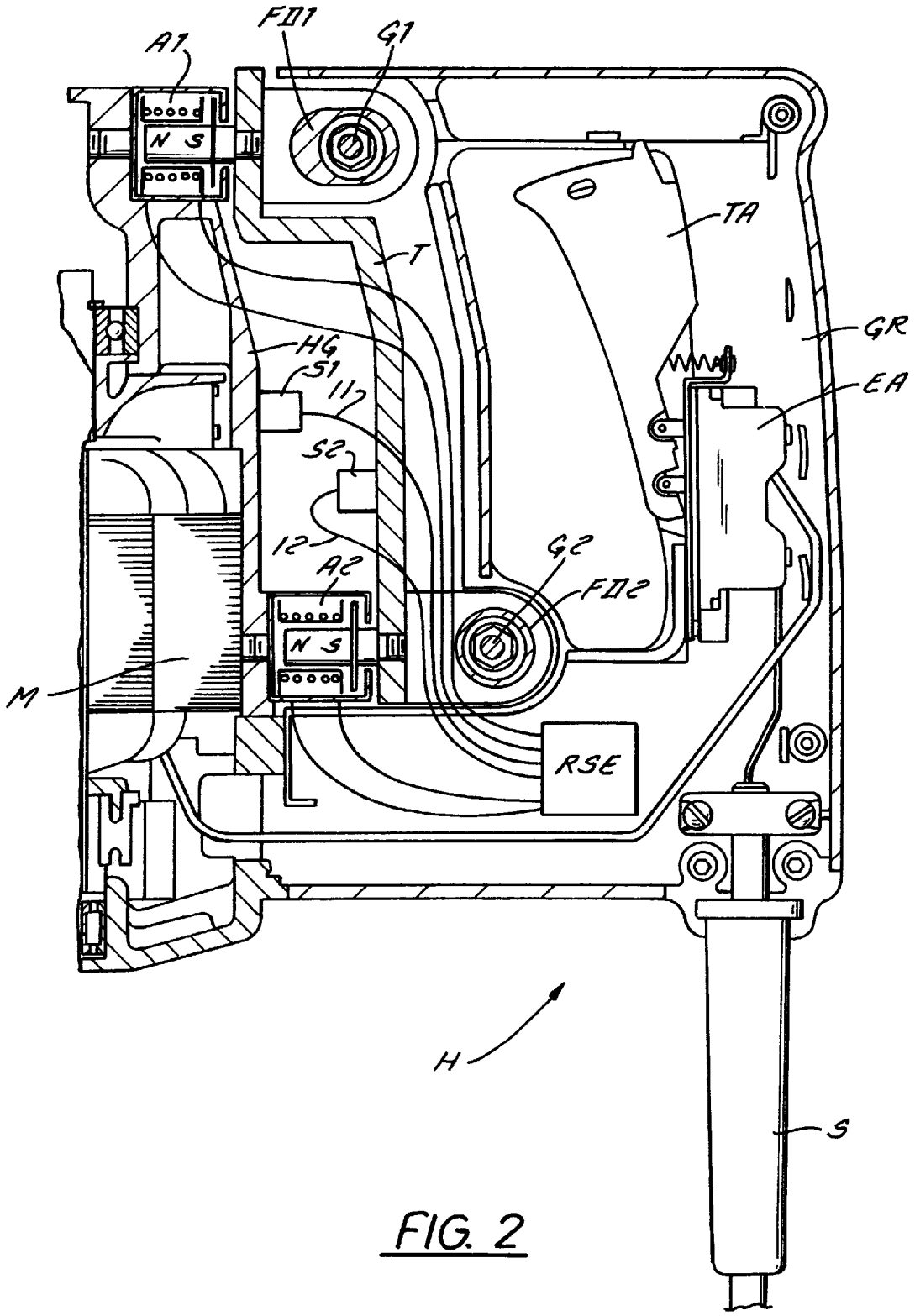
FIG. 2 shows a detail section through the end of the tool having the handle, on an enlarged scale.

Illustrated in FIGS. 1 and 2 is a breaker and/or hammer drill H which is configured in accordance with the invention and has a handle GR with a power feed S and an on/off switch EA that is actuated by means of a push button TA. Accommodated in the handle GR is a regulating and control unit RSE, whose function will be explained further below. Via a first joint G1 having a first spring/damper element FD1, and a second joint G2 having a second spring/damper element FD2, using joint axes that run transversely to the percussion direction of the tool and parallel to one another, a carrier T is connected to the handle GR, to which carrier a tool housing HG, which can move in relation to the carrier T and to the handle GR, is connected via a first electromagnetically operable actuator A1 and a second electromagnetically operable actuator A2, a drive motor M and a fitting WA, which can be driven by the latter and is intended for a percussion tool (not shown), being arranged in the housing. The direction of action of the actuators A1 and A2 runs parallel to the percussion or guide direction of the tool. In addition, the tool housing HG bears an auxiliary handle FG for the better guidance of the tool.

Fitted to the tool housing HG is an input sensor S1 which is suitable to measure the vibration of the tool housing and to output a first measured signal $I_1$, which depends on the vibration of the tool housing HG in the guide direction of the tool, to the regulating and control unit RSE.

A fault sensor S2 is fitted to the carrier T. It is suitable to output a signal $I_2$, which depends on the vibration of the handle GR in this guide direction, to the regulating and control unit RSE.

On the basis of the input signals $I_1$ and $I_2$ the actuators A1 and A2 are activated by the regulating and control unit RSE in such a way that their oscillation amplitudes are controlled in antiphase to the vibration of the tool housing HG and, in terms of their magnitude, correspond to as large an extent as possible to the magnitude of the vibration of the tool housing. The vibrational movement of the tool housing HG is thus compensated by the oppositely directed vibrational movement at the actuators A1 and A2 and, as a result, is at least for the most part kept away from the handle GR.

Instead of compensating the vibrational movement of the tool housing by a corresponding countermovement produced by the actuators A1 and A2 which act as displacement transducers, it is also possible for the force otherwise producing the vibrational movement of the tool housing to be compensated or neutralized by an oppositely directed compensation force and, as a result, for the production of a vibrational movement at all to be suppressed. For this purpose it is necessary to use force-exciting actuators instead of actuators that act as displacement transducers.

FIGS. 3A–3H show possible embodiments of tools having actuators $A_w$ that act as displacement transducers and actuators $A_k$ that act as force transducers the number of actuators A also varying.

Figure 3A:
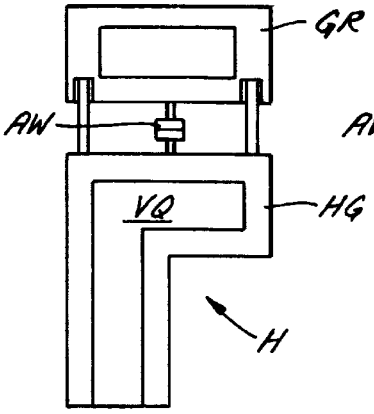
FIGS. 3A–3H show a schematic view of different embodiments of a device according to the invention.

Shown in FIG. 3A, is a tool in which the tool housing is guided at the handle in the direction of oscillation of the tool via guide rods which are fitted to the tool housing and which engage in the handle. Arranged between handle GR and tool housing HG, and connected to both, is an actuator $A_w$ that acts as a displacement transducer and that controls the relative movement between the handle GR and the tool housing HG such that the handle remains virtually at rest.

Figure 3B:
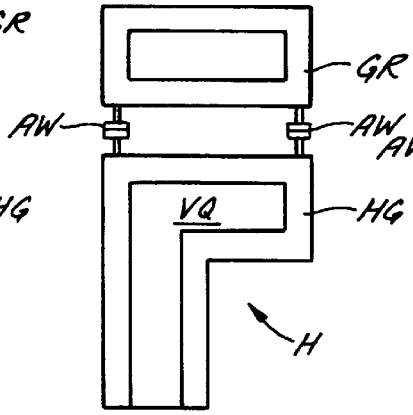

In the embodiment of FIG. 3B, the guides are unnecessary, since handle and tool housing HG are connected by two actuators $A_w$ that act as displacement transducers and that are arranged in parallel at a mutual spacing.

Figure 3C:
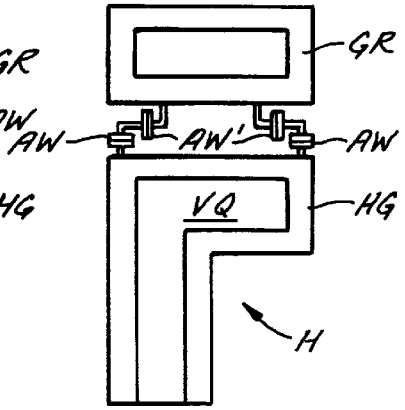

FIG. 3C shows two pairs of actuators, each pair comprising 1) at first actuator $A_w$ that acts as a displacement transducer and that acts in the guide direction of the percussion tool and 2) an actuator $A_w$ that acts as a displacement transducer and that acts transversely to the first $A_w$, in order also to be able to compensate for vibrations acting in this transverse direction.

Figure 3D:
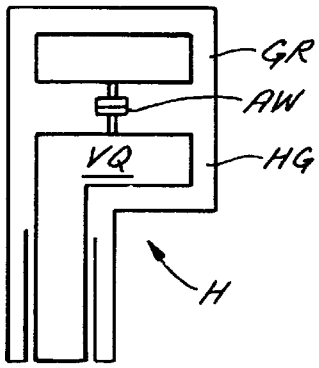
Figure 3E:
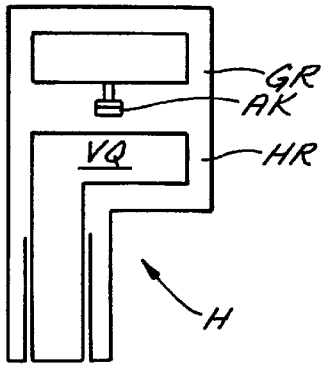
Figure 3F:
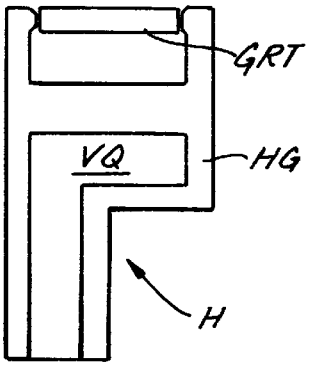

The tool H shown in FIG. 3D is provided with an actuator $A_w$ which acts as a displacement transducer and which, as illustrated schematically, acts directly between the oscillation-exciting hammer part VQ (VQ=vibration source), which is located in the tool housing and from which the vibration originates, and the further parts of the tool H, so that it is possible for the handle GR to be firmly connected to the tool housing HG.

The corresponds in its overall arrangement to the embodiment of FIG. 3D, with the difference that the actuator is an actuator $A_k$ that acts as a force transducer and the exerts on these further parts of the tool a controlled compensating force. The counteracting force counteracts the force which originates from the oscillating part VQ of the tool H and which acts on the further parts.

Figure 3G:
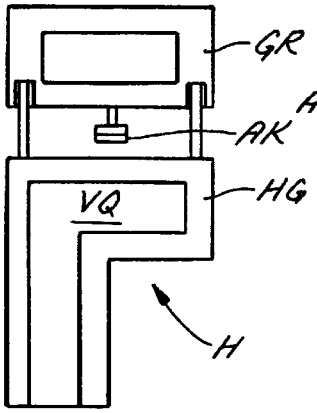

The embodiment of FIG. 3G is a variant corresponding to the above-described embodiment of FIG. 3A in which and the actuator $A_k$ compensates for the force which acts from the guide on the handle GR and is able to set the handle GR vibrating so that the handle GR remains virtually at rest.

Figure 3H:
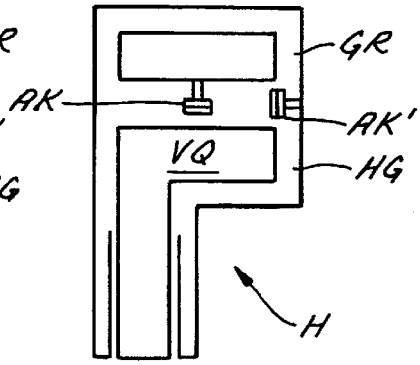

The embodiment of FIG. 3H corresponds to the embodiment of FIG. 3D, with the difference that, in addition, a force-exciting actuator $A_k$ is provided in order to compensate for the forces occurring transversely to the guide direction. These forces originate from the oscillating or vibrating hammer part VQ and are able to excite oscillations or vibrations in the further parts of the tool H.

The differs from all the other embodiments in the fact that the grip part of the handle has a shape which can be varied in a controllable manner, and the shape change is controlled in a way which compensates for the vibrations of the tool housing HG depending on the forces which act from the hammer on the grip piece and are measured in a known way.

What is claimed is:

1. A tool with active vibration damping comprising: an operating element and a handle that guides the operating element, wherein the operating element is driven by an integrated power drive for the percussive, pounding or vibratory loading of a material to be worked, wherein the operating element comprises one of 1) a tamper, a vibration plate or a vibration roll for ground compaction and 2) a hammer for at least one of breaking and drilling operations, wherein at least one vibration sensor is mounted to the tool and is operable to sense vibrations at least one if in and on said tool and to generate an oscillating vibration signal having a phase, wherein the handle is actively vibration-damped by at least one actively controlled or actively regulated powered compensation element which counteracts the transmission of a vibration to said handle and which, depending on the vibration that can be transmitted to it and is produced at least one of in the tool and on the tool, is selectively energized by a regulating and control unit in response to the vibration signal, so as to produce at least one of a compensating force and a compensating movement in a potential vibration transmission path extending from a location of a source of the vibration to said handle, and wherein said compensation element is energized in antiphase to the vibration signal produced by the vibration sensor.

2. The tool as claimed in claim 1, which comprises a plurality of actively regulated compensation elements which act at least one of serially and in parallel with one another in the potential vibration transmission path.

3. The tool as claimed in claim 1, wherein the compensation element comprises a plurality of compensation elements which are arranged so as to act in the same direction and which are provided in parallel with one another.

4. The tool as claimed in claim 1, wherein the compensation elements act in at least two different directions and are actively regulated separately in the individual directions.

5. The tool as claimed in claim 1, wherein passive damping elements are also provided in the potential vibration transmission path.

6. The tool as claimed in claim 1, wherein the handle has a grip part having a shape which can be varied in a regulated manner, wherein a characteristic of the shape variation is dependent on the vibration that can be transmitted to it and that is produced at least one of in the tool and on the tool.

7. The tool as claimed in claim 1, wherein the tool is at least one of a breaker and a hammer drill;

the handle is movable relative to a tool housing against the force of a spring; and wherein at least one actuator is arranged between the tool housing and the handle and is capable of oscillating in a direction of a force transmission in order to guide the tool, wherein an oscillation amplitude of the actuator is controlled by said regulating and control unit in antiphase to a vibration of the tool housing as a function of at least one of 1) a first measured signal which corresponds to a magnitude of the vibration of the tool housing in the direction of force transmission and 2) a second measured signal which corresponds to a magnitude of a vibration of the handle in the direction of force transmission.

8. The tool as claimed in claim 7, wherein the handle is connected to the tool housing via joints arranged at a mutual spacing in a direction transverse to a tool longitudinal axis, wherein the actuator is arranged between one of the joints and the tool housing.

9. The tool as claimed in claim 8, wherein a separate actuator is inserted between each joint and the tool housing.

10. The tool as claimed in claim 9, wherein the joints are fitted rigidly to a common carrier, which is connected to the tool housing via the actuators.

11. The tool as claimed in claim 7, wherein the actuators comprise electromagnetic displacement transducers.

12. The tool as claimed in claim 7, wherein the joints are implemented so as to be elastic within limits, such that they also act as passive, elastic damping elements in the vibration transmission path from the tool housing to the handle.

13. A tool with active vibration damping comprising:

(A) a tool housing;

(B) an operating element which is supported on the tool housing and which comprises one of a tamper, a vibration plate, a vibration roll, and a hammer;

(C) a power drive which drives said operating element for at least one of 1) the percussive, pounding, or vibratory loading a braking of a material to be worked and 2) a breaking or a drilling of a material to be worked;

(D) a handle which is supported on said tool housing and which guides said tool, wherein, during operation of said tool, said handle is potentially subject to vibrational forces transmitted to said handle from a source of vibration through a potential vibration transmission path;

(E) a vibration sensor which is mounted to said tool and which is configured to sense vibrations at least one of in and on said tool and to generate an oscillating vibration signal having a phase;

(F) a regulating and control unit which is coupled to said vibration sensor; and (G) an active compensation element which is dynamically energized by said regulating and control unit in response to the vibration signal to counteract vibrational forces being transmitted towards said handle from said source, wherein said compensation element produces at least one of a compensating force and a compensating movement in the potential vibration transmission path that varies as a function of vibrations generated by the source, and wherein said compensation element is energized in antiphase to the vibration signal produced by the vibration sensor.

14. A tool as recited in claim 13, wherein a plurality of said active compensation elements are provided.

15. A tool as recited in claim 14, wherein at least two of said active compensation elements are provided in parallel with one another and are arranged to act in a common direction.

16. A tool as recited in claim 14, wherein said compensation elements act in at least two different directions and are regulated separately in the different directions.

17. A tool as recited in claim 13, further comprising at least one passive damping element that is located in the potential vibration transmission path and that passively damps vibrations without being actively controlled.

18. The tool as recited in claim 13, wherein said vibration sensor senses vibration of at least one of said handle and said tool housing and which generates a vibration signal indicative of a magnitude of the sensed vibration and 2) said regulating and control unit is configured to transmit an oscillating control signal to said compensation element which is in antiphase to a vibration of the tool housing and which has an amplitude that varies as a function of a magnitude of said vibration signal.

19. The tool as recited in claim 18, wherein said vibration sensor comprises at least one of a first sensor that senses vibration of said handle and a second sensor that senses vibration of said tool housing.

* * * * *